United States Patent [19]

Burton

[11] 4,228,920

[45] Oct. 21, 1980

[54] DISPENSER FOR SMALL ARTICLES HAVING ARTICLE ORIENTATION MEANS

[75] Inventor: George W. Burton, London, England

[73] Assignee: Johnson & Jorgensen (Plastics) Limited, United Kingdom

[21] Appl. No.: 933,433

[22] Filed: Aug. 14, 1978

[30] Foreign Application Priority Data

Aug. 15, 1977 [GB] United Kingdom ..... 34158/77

[51] Int. Cl.[3] ..... B65D 83/04

[52] U.S. Cl. ..... 221/265

[58] Field of Search ..... 221/265, 263, 203, 266, 221/186, 187, 188, 225, 237, 2, 4, 5, 91

[56] References Cited

U.S. PATENT DOCUMENTS 3,245,589 4/1966 Temliak ..... 221/265 X

FOREIGN PATENT DOCUMENTS 2615423 10/1977 Fed. Rep. of Germany ..... 221/265

*Primary Examiner*—Stanley H. Tollberg

*Attorney, Agent, or Firm*—Newton, Hopkins & Ormsby

[57] ABSTRACT

The invention provides a dispenser for dispensing articles such as sweeteners one at a time from a supply of such articles held within the dispenser. The dispenser consists of two parts, a container closed at one end and open at the other end and a cap to close the open end of the container. A device is provided within the container and connected to the cap for segregating and orienting the articles as they are moved towards the cap and there is an opening in the cap through which the articles can be dispensed. There is a pocket or cut-out in the side wall of the container at the open end and there is a protective ramp adjacent to the opening to prevent more than one article being dispensed at one time.

8 Claims, 8 Drawing Figures

DISPENSER FOR SMALL ARTICLES HAVING ARTICLE ORIENTATION MEANS

Figure 1:
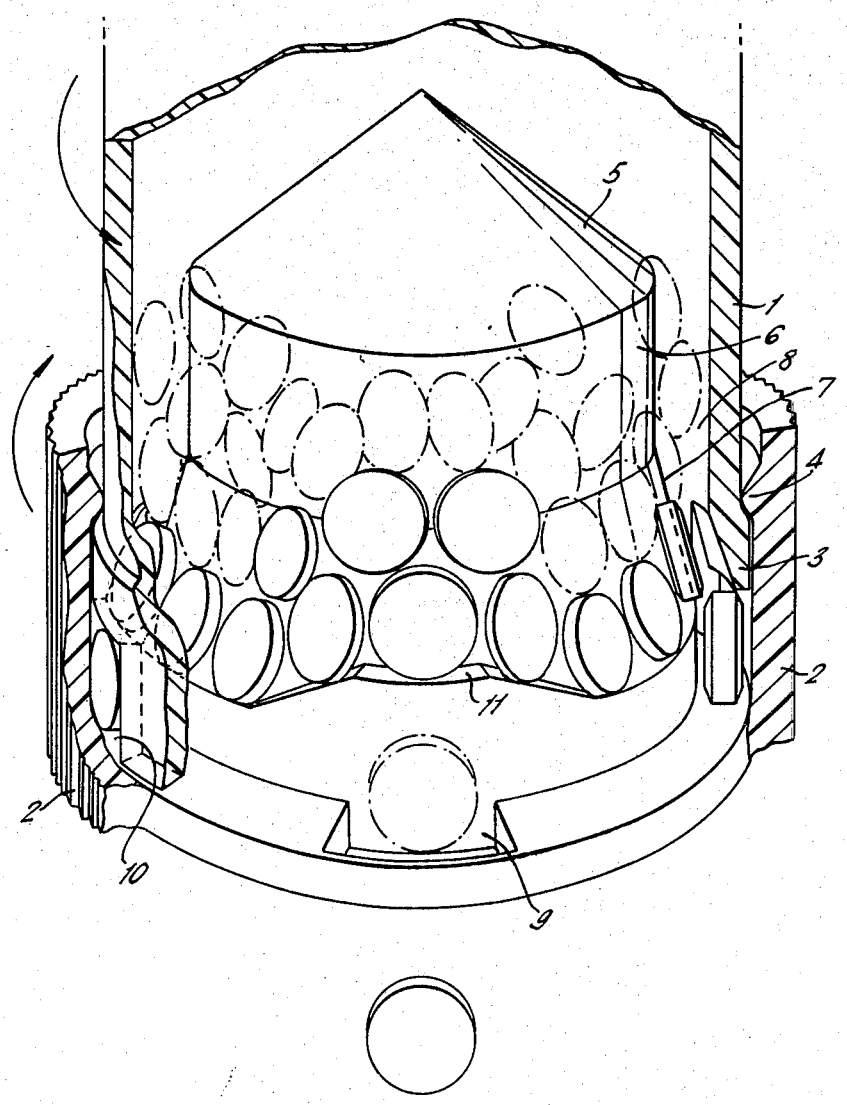

This invention relates to dispensers for delivering a succession of groups of articles such as pills or tablets. Each group may consist of a single article or a number of articles.

It is common practice to provide a container with an adjustable closure adapted to be manipulated manually to uncover an opening to allow articles within the container to be dispensed. However in such a simple dispenser the articles are apt to come out with a rush and if a user requires just one article e.g. a sweetening saccharin or like tablet it is a nuisance to be confronted with six or seven at one time.

It has also been proposed to provide a dispenser adapted to dispense articles one group at a time but such dispensers have always been rather complicated.

It is an object of the present invention to provide an improved dispenser for delivering a succession of groups of articles each group consisting of a predetermined number of articles.

To dispense objects one group at a time for example to dispense substantially flat tablets one at a time we believe calls for the following conditions:

1. The tablets must be orientated to line up with an elongate dispensing opening.
2. Individual tablets must be separated from the pack or bulk of tablets and must be either carried to the dispensing opening or the opening must be moved to the tablets in turn.
3. Some form of shield must prevent more than one tablet being dispensed at a time. This can be achieved by producing a compartment or pocket around the tablet immediately adjacent to the dispensing opening. Once the tablet has been dispensed the compartment remains empty until the dispenser is operated again.
4. The tablets need some form of agitation to prevent clogging.

According to the present invention there is provided a dispenser for dispensing articles one group at a time from a supply of substantially identical articles wherein the dispenser comprises a container and a cap to close an open end of the container, means within the container and connected to the cap for segregating and orienting the articles as they are moved towards the cap, an opening in the cap through which articles can be dispensed, at least one pocket in the side wall of the container at the open end of the container and a protective ramp adjacent to the opening.

The invention also includes a dispenser for dispensing articles one group at a time from a supply of such articles which are all of the same size and shape wherein the dispenser comprises a container defined by a side wall and a closed end for holding a random supply of articles and having an open mouth remote from the closed end, a cap to close the open mouth of the container, an opening in the cap through which articles can be dispensed one group at a time when the dispenser is in an inverted position, a segregating member arranged within the container extending from the open mouth towards the closed end and dimensioned to provide a gap between the member and the container side wall into which a number of articles can pass and a pocket in the side wall of the container at the mouth thereof to receive a group of articles from the gap, whereby relative rotation between the cap and the container causes a group of articles to be dispensed from the pocket when the pocket moves into registration with the opening, guard means being provided to prevent a further group of articles moving into the pocket until the pocket no longer registers with the opening.

Figure 2:
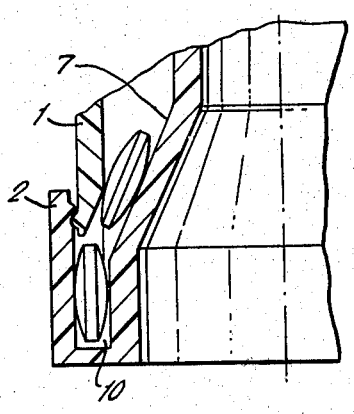
Figure 3:
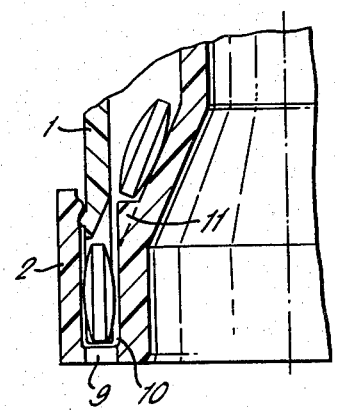
Figure 5:
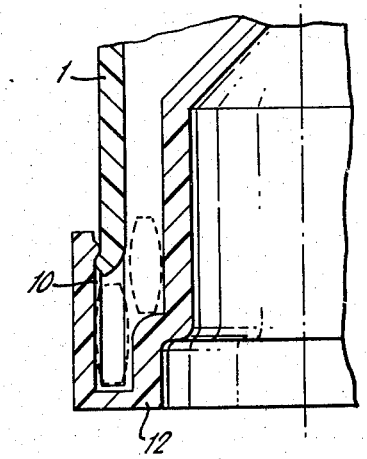
Figure 6:
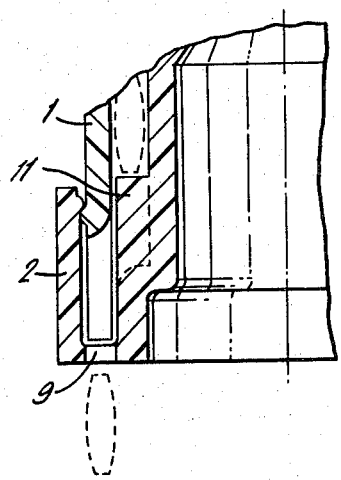
Figure 4:
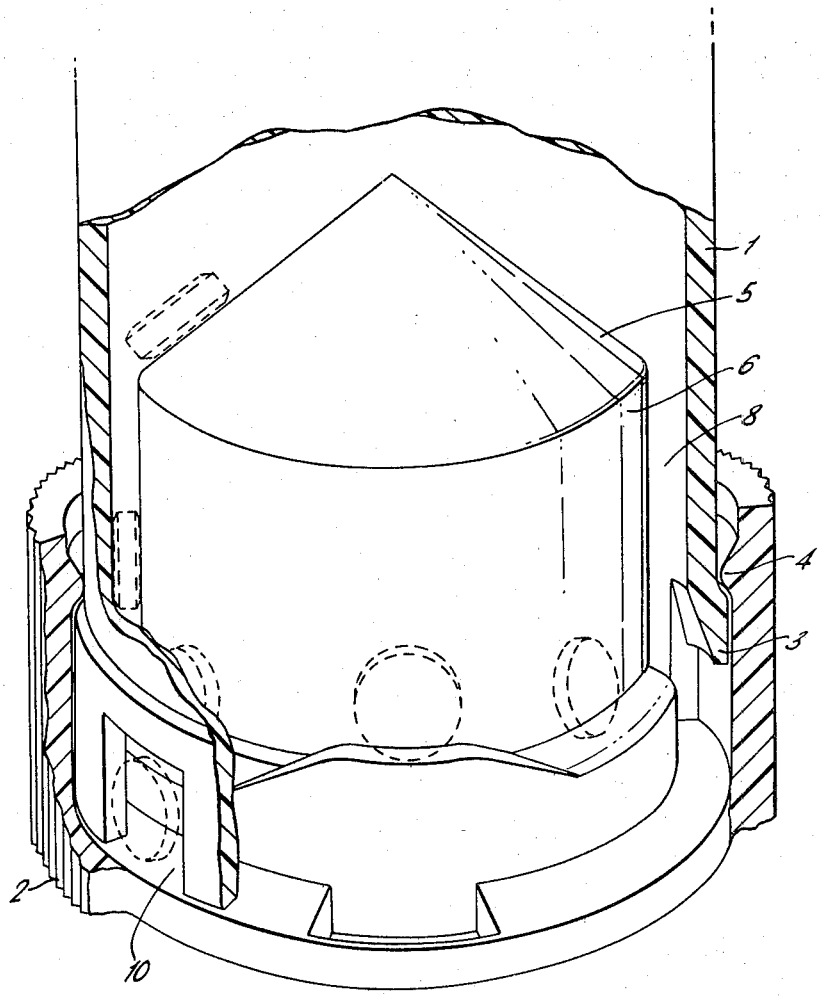
Figure 7:
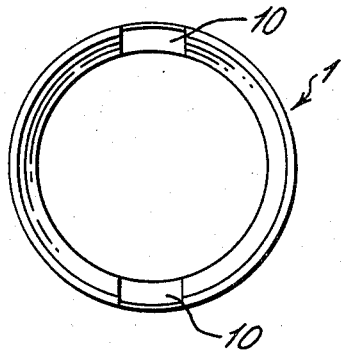
Figure 8:
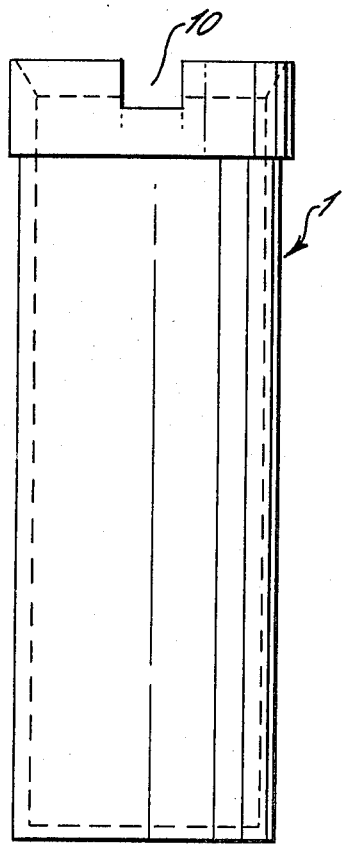

In order that the invention may be clearly understood reference is now directed by way of example to the accompanying drawings in which FIG. 1 is a sectional perspective view of a dispenser in accordance with the invention shown in inverted position in which articles can be dispensed, FIGS. 2 and 3 are detail sectional views FIG. 4 is a view similar to FIG. 1 of a slightly modified form of dispenser in accordance with the invention, FIGS. 5 and 6 are views similar to FIGS. 2 and 3, FIG. 7 is a plan view of the container, and FIG. 8 is a side view of the container.

Referring to FIG. 1 the dispenser comprises a tubular container 1 and a cap 2 to close the open mouth of the container 1. The container has an annular external bead 3 and the cap has an annular internal bead 4 in the skirt of the cap so that the cap 2 can snap in to the closed position on the container 1. When in position the cap 2 can be turned relatively to the container 1 but cannot easily be pulled off axially. The cap 2 has a segregating member in the form of a central spigot 5 which has a cylindrical part 6 and a frustoconical part 7. An annular gap 8 is provided between the side wall of the container and the spigot 5. The cap 2 has an opening 9 through which articles can be dispensed and the edge of the side wall of the container 1 at the open end has a number of cut outs forming pockets 10 each of a size and shape to receive a single article. The spigot 5 has a ramp 11 positioned above the opening 9 when the dispenser is in the position shown in FIG. 1. When the dispenser is in an upright position with the cap at the top the bulk of the articles will be in the lower part of the container. When it is desired to dispense an article the position of the dispenser is reversed so that some of the articles fall down into the gap 8 and become correctly oriented for dispensing. A single article will enter each pocket 10 with the exception of the pocket immediately above the opening 9 which remains empty because it is protected by the ramp 11 which prevents an article entering that pocket. Next the cap 2 is turned relatively to the container 1 so that when the opening 9 is moved into registration with a full pocket an article will be dispensed from that pocket. Although we have referred above to moving the cap 2 relatively to the container 1 the same effect is produced if the container be moved relatively to the cap.

If it be desired to dispense a group of two, three or more articles at a time the pockets will be made sufficiently large to receive two, three or more articles as the case may be.

FIG. 2 shows an article in one of the pockets 10 which in this embodiment are made just large enough to accommodate one article. FIG. 3 shows an article about to be dispensed from the pocket 10 through the opening 9 and also shows how the projection of the ramp 11 prevents another article dropping into a pocket from which an article has just been or is about to be dispensed.

It will be noted that the spigot 5 includes the cylindrical part 6 with a relatively large gap 8 between the spigot and the container wall. Below the part 6, with the dispenser in the position shown in FIG. 1, the spigot 5 is flared outwardly at the frustoconical part 7 towards the container wall so that the gap 8 between the spigot and the container wall narrows. This arrangement assists in correct orientation of the articles to be dispensed in that the articles move from a random arrangement in the upper part of the container away from the mouth to an orderly arrangement in the narrower part of the gap 8.

In some embodiments of the invention it may be necessary to make the dispenser in three parts i.e. a container body, a container bottom and a cap. In that case when the dispenser is assembled and the bottom is secured to the container body the dispenser comprises only two parts. However the embodiment described above may be actually manufactured in two parts, a container body complete and a cap and that is an important feature of the invention.

The embodiment illustrated in FIGS. 4, 5 and 6 is similar to the embodiment described in connection with FIGS. 1, 2 and 5. The same references have been used and no further description is needed.

We claim:

1. A dispenser for dispensing disc-like articles one at a time from a supply of said articles, the dispenser comprising a container for the supply of disc-like articles and a closure cap for an open end of the container, a segregating and orienting member on the cap projecting inside of the container and defining with the container side wall a restricted passage of sufficient width only to receive a plurality of the disc-like articles on their edges, said passage being of insufficient width to receive said articles with their major end faces across the axis of the container and closure cap, the closure cap having an opening through which the disc-like articles one at a time are dispensed while the closure cap is arranged lowermost and the container uppermost, at least a single article receptor and transport pocket in the side wall of the container at the open end thereof whereby single disc-like articles are delivered to said opening in the cap by relative rotation of the container and cap, and an article blocking element on the segregating and orienting member to prevent the passage of more than one article at a time to said opening of the closure cap when said cap and container are adjusted to a dispensing position.

2. A dispenser for dispensing articles one group at a time from a supply of such articles which are all of the same size and shape wherein the dispenser comprises a container defined by a side wall and a closed end for holding a random supply of articles and having an open mouth remote from the closed end, a cap to close the open mouth of the container, an opening in the cap through which articles can be dispensed one group at a time when the dispenser is in an inverted position, a segregating member arranged within the container extending from the open mouth towards the closed end and dimensioned to provide a gap between the member and the container side wall into which a number of the articles can pass and a pocket or cut out in the side wall of the container at the mouth thereof to receive a group of articles from the gap, whereby relative rotation between the cap and the container causes a group of articles to be dispensed from the pocket when the pocket moves into registration with the opening, guard means being provided to prevent a further group of articles moving into the pocket until the pocket no longer registers with the opening.

3. A dispenser according to claim 1 or 2 wherein the container is tubular and wherein the cap is arranged to snap on to the container.

4. A dispenser for dispensing articles according to claim 1, wherein the side wall of said container at its open end has a plurality of pockets in circumferentially spaced relationship.

5. A dispenser as defined in claim 1 and said opening of the closure cap being formed through the end wall of the closure cap beyond the outer margin of the segregating and orienting member and the article blocking element.

6. A dispenser as defined in claim 1, wherein said container is cylindrical and said segregating and orienting member on the cap is a spigot element spaced from the side wall of the container concentrically therewith and including a cylindrical body portion and a frustoconical end portion away from said cap.

7. A dispenser for dispensing articles one at a time from a supply of substantially identical articles wherein the dispenser is formed in two parts consisting of a tubular container body closed at the bottom end and open at the top end and a rotatable cap to close the open end of the body, segregating means connected to the cap and projecting into the body for segregating and orienting the articles as they are moved toward the cap when the dispenser is in an inverted position with the top at a lower level than the bottom, an opening in the cap through which articles can be dispensed, at least one pocket in the side wall of the container at the open end dimensioned to receive articles one at a time, and a protective ramp connected to the segregating means to prevent more than one article entering a pocket at the same time, whereby relative rotation between the cap and the body is effective to dispense articles one by one.

8. A container for dispensing articles one at a time from a supply of identical articles held within the container wherein the dispenser comprises a container body, a cap to close an open top end of the container, a segregating member within the container body and connected to the cap for segregating and orienting the articles as they are moved toward the cap when the dispenser is inverted, an opening in the cap through which articles can be dispensed one at a time, at least one cut out pocket in the top edge of the container body dimensioned to receive one article at a time and a protective ramp on the segregating member to prevent more than one article being dispensed at the same time, dispensing being effected by angular displacement of the cap relative to the body with the dispenser in an inverted position to bring the cut out pocket containing one article into registration with the opening in the cap.

* * * * *